United States Patent [19]

Campbell

[11] Patent Number: 5,071,135

[45] Date of Patent: Dec. 10, 1991

[54] BOARD GAME APPARATUS FOR THE TEACHING OF FINANCIAL MANAGEMENT PRINCIPLES

[76] Inventor: Thomas J. Campbell, 4511-264th Avenue N.E., Redmond, Wash. 98053

[21] Appl. No.: 537,052

[22] Filed: Jun. 12, 1990

[51] Int. Cl.[5] ..... A63F 3/00

[52] U.S. Cl. ..... 273/256

[58] Field of Search ..... 273/256, 278

[56] References Cited

U.S. PATENT DOCUMENTS

| | | | |
|---|---|---|---|
| 2,666,644 | 1/1954 | Strehlow | 273/256 |
| 2,693,961 | 11/1954 | Ripley | 273/256 |
| 3,539,189 | 11/1970 | Shelton | 273/256 |
| 4,915,391 | 4/1990 | Aharonian | 273/256 |
| 4,936,589 | 6/1990 | Sinclair | 273/256 |

*Primary Examiner*—Benjamin Layno

*Attorney, Agent, or Firm*—Eckert Seamans Cherin & Mellott

[57] ABSTRACT

A board game is disclosed which includes a game board having a peripheral playing path divided into several fields. The fields represents opportunities to buy or sell housing or stock, personal expenses to be paid, and salary to be received. The playing path is represented as one calendar year, and the fields are grouped into the four financial quarters of the year, wherein each side of the board represents a financial quarter. The game further includes game pieces representing housing and stock, tokens, dice for determining movement of the tokens along the path, and simulated currency. Also included are returns tables having indexed monetary amounts. The dice randomly selects a monetary amount and this amount is added to the value of an investment, adjusting its value. The game involves players buying and selling stocks and housing, paying personal expenses, rent and taxes, and receiving income. The object being to build the greatest financial worth.

8 Claims, 8 Drawing Sheets

202

| | | | | | | | | | | | | | | |
|---|---|---|---|---|---|---|---|---|---|---|---|---|---|---|
| age | 15 | 20 | 25 | 30 | 35 | 40 | 45 | 50 | 55 | 60 | 65 |
| salary | 00 | 800 | 1700 | 2500 | 3300 | 4200 | 5000 | 5800 | 6700 | 7500 | 8300 |
| cash (1000s) | 00 | 10 | 40 | 90 | 160 | 250 | 360 | 490 | 640 | 810 | 1000 |

204

| |
|---|
| 0,000 |
| 10 |
| 40 |
| 90 |
| 160 |
| 250 |
| 360 |
| 490 |
| 640 |
| 810 |
| 1,000 |
| 1,210 |
| 1,440 |
| 1,690 |
| 1,960 |
| 2,250 |

206

| | | | | | | | | | | | | | | |
|---|---|---|---|---|---|---|---|---|---|---|---|---|---|---|
| 15 | | | | | | | | | | | | | | |
| 30 | | | | | | | | | | | | | | |
| 45 | | | | | | | | | | | | | | |
| 60 | | | | | | | | | | | | | | |
| 75 | | | | | | | | | | | | | | |
| 90 | | | | | | | | | | | | | | |
| 105 | | | | | | | | | | | | | | |
| 120 | | | | | | | | | | | | | | |
| 135 | | | | | | | | | | | | | | |
| 150 | | | | | | | | | | | | | | |
| 165 | | | | | | | | | | | | | | |
| 180 | | | | | | | | | | | | | | |
| | 15 | | | | | | | | | | | | | |
| | 30 | | | | | | | | | | | | | |
| | 45 | | | | | | | | | | | | | |
| | 60 | | | | | | | | | | | | | |
| | 75 | | | | | | | | | | | | | |
| | 90 | | | | | | | | | | | | | |
| | 105 | | | | | | | | | | | | | |
| | 120 | | | | | | | | | | | | | |
| | 135 | | | | | | | | | | | | | |
| | 150 | | | | | | | | | | | | | |
| | 165 | | | | | | | | | | | | | |
| | 180 | | | | | | | | | | | | | |
| | | 15 | | | | | | | | | | | | |
| | | 30 | | | | | | | | | | | | |
| | | 45 | | | | | | | | | | | | |
| | | 60 | | | | | | | | | | | | |
| | | 75 | | | | | | | | | | | | |
| | | 90 | | | | | | | | | | | | |
| | | 105 | | | | | | | | | | | | |
| | | 120 | | | | | | | | | | | | |
| | | 135 | | | | | | | | | | | | |
| | | 150 | | | | | | | | | | | | |
| | | 165 | | | | | | | | | | | | |
| | | 180 | | | | | | | | | | | | |
| | | | 15 | | | | | | | | | | | |
| | | | 30 | | | | | | | | | | | |
| | | | 45 | | | | | | | | | | | |
| | | | 60 | | | | | | | | | | | |
| | | | 75 | | | | | | | | | | | |
| | | | 90 | | | | | | | | | | | |
| | | | 105 | | | | | | | | | | | |
| | | | 120 | | | | | | | | | | | |
| | | | 135 | | | | | | | | | | | |
| | | | 150 | | | | | | | | | | | |
| | | | 165 | | | | | | | | | | | |
| | | | 180 | | | | | | | | | | | |
| | | | | 15 | | | | | | | | | | |
| | | | | 30 | | | | | | | | | | |
| | | | | 45 | | | | | | | | | | |
| | | | | 60 | | | | | | | | | | |
| | | | | 75 | | | | | | | | | | |
| | | | | 90 | | | | | | | | | | |
| | | | | 105 | | | | | | | | | | |
| | | | | 120 | | | | | | | | | | |
| | | | | 135 | | | | | | | | | | |
| | | | | 150 | | | | | | | | | | |
| | | | | 165 | | | | | | | | | | |
| | | | | 180 | | | | | | | | | | |
| | | | | | 15 | | | | | | | | | |
| | | | | | 30 | | | | | | | | | |
| | | | | | 45 | | | | | | | | | |
| | | | | | 60 | | | | | | | | | |
| | | | | | 75 | | | | | | | | | |
| | | | | | 90 | | | | | | | | | |
| | | | | | 105 | | | | | | | | | |
| | | | | | 120 | | | | | | | | | |
| | | | | | 135 | | | | | | | | | |
| | | | | | 150 | | | | | | | | | |
| | | | | | 165 | | | | | | | | | |
| | | | | | 180 | | | | | | | | | |
| | | | | | | 15 | | | | | | | | |
| | | | | | | 30 | | | | | | | | |
| | | | | | | 45 | | | | | | | | |
| | | | | | | 60 | | | | | | | | |
| | | | | | | 75 | | | | | | | | |
| | | | | | | 90 | | | | | | | | |
| | | | | | | 105 | | | | | | | | |
| | | | | | | 120 | | | | | | | | |
| | | | | | | 135 | | | | | | | | |
| | | | | | | 150 | | | | | | | | |
| | | | | | | 165 | | | | | | | | |
| | | | | | | 180 | | | | | | | | |
| | | | | | | | 15 | | | | | | | |
| | | | | | | | 30 | | | | | | | |
| | | | | | | | 45 | | | | | | | |
| | | | | | | | 60 | | | | | | | |
| | | | | | | | 75 | | | | | | | |
| | | | | | | | 90 | | | | | | | |
| | | | | | | | 105 | | | | | | | |
| | | | | | | | 120 | | | | | | | |
| | | | | | | | 135 | | | | | | | |
| | | | | | | | 150 | | | | | | | |
| | | | | | | | 165 | | | | | | | |
| | | | | | | | 180 | | | | | | | |
| | | | | | | | | 15 | | | | | | |
| | | | | | | | | 30 | | | | | | |
| | | | | | | | | 45 | | | | | | |
| | | | | | | | | 60 | | | | | | |
| | | | | | | | | 75 | | | | | | |
| | | | | | | | | 90 | | | | | | |
| | | | | | | | | 105 | | | | | | |
| | | | | | | | | 120 | | | | | | |
| | | | | | | | | 135 | | | | | | |
| | | | | | | | | 150 | | | | | | |
| | | | | | | | | 165 | | | | | | |
| | | | | | | | | 180 | | | | | | |
| | | | | | | | | | 15 | | | | | |
| | | | | | | | | | 30 | | | | | |
| | | | | | | | | | 45 | | | | | |
| | | | | | | | | | 60 | | | | | |
| | | | | | | | | | 75 | | | | | |
| | | | | | | | | | 90 | | | | | |
| | | | | | | | | | 105 | | | | | |
| | | | | | | | | | 120 | | | | | |
| | | | | | | | | | 135 | | | | | |
| | | | | | | | | | 150 | | | | | |
| | | | | | | | | | 165 | | | | | |
| | | | | | | | | | 180 | | | | | |
| | | | | | | | | | | 15 | | | | |
| | | | | | | | | | | 30 | | | | |
| | | | | | | | | | | 45 | | | | |
| | | | | | | | | | | 60 | | | | |
| | | | | | | | | | | 75 | | | | |
| | | | | | | | | | | 90 | | | | |
| | | | | | | | | | | 105 | | | | |
| | | | | | | | | | | 120 | | | | |
| | | | | | | | | | | 135 | | | | |
| | | | | | | | | | | 150 | | | | |
| | | | | | | | | | | 165 | | | | |
| | | | | | | | | | | 180 | | | | |
| | | | | | | | | | | | 15 | | | |
| | | | | | | | | | | | 30 | | | |
| | | | | | | | | | | | 45 | | | |
| | | | | | | | | | | | 60 | | | |
| | | | | | | | | | | | 75 | | | |
| | | | | | | | | | | | 90 | | | |
| | | | | | | | | | | | 105 | | | |
| | | | | | | | | | | | 120 | | | |
| | | | | | | | | | | | 135 | | | |
| | | | | | | | | | | | 150 | | | |
| | | | | | | | | | | | 165 | | | |
| | | | | | | | | | | | 180 | | | |
| | | | | | | | | | | | | 15 | | |
| | | | | | | | | | | | | 30 | | |
| | | | | | | | | | | | | 45 | | |
| | | | | | | | | | | | | 60 | | |
| | | | | | | | | | | | | 75 | | |
| | | | | | | | | | | | | 90 | | |
| | | | | | | | | | | | | 105 | | |
| | | | | | | | | | | | | 120 | | |
| | | | | | | | | | | | | 135 | | |
| | | | | | | | | | | | | 150 | | |
| | | | | | | | | | | | | 165 | | |
| | | | | | | | | | | | | 180 | | |
| | | | | | | | | | | | | | 15 | |
| | | | | | | | | | | | | | 30 | |
| | | | | | | | | | | | | | 45 | |
| | | | | | | | | | | | | | 60 | |
| | | | | | | | | | | | | | 75 | |
| | | | | | | | | | | | | | 90 | |
| | | | | | | | | | | | | | 105 | |
| | | | | | | | | | | | | | 120 | |
| | | | | | | | | | | | | | 135 | |
| | | | | | | | | | | | | | 150 | |
| | | | | | | | | | | | | | 165 | |
| | | | | | | | | | | | | | 180 | |
| | | | | | | | | | | | | | | 15 |
| | | | | | | | | | | | | | | 30 |
| | | | | | | | | | | | | | | 45 |
| | | | | | | | | | | | | | | 60 |
| | | | | | | | | | | | | | | 75 |
| | | | | | | | | | | | | | | 90 |
| | | | | | | | | | | | | | | 105 |
| | | | | | | | | | | | | | | 120 |
| | | | | | | | | | | | | | | 135 |
| | | | | | | | | | | | | | | 150 |
| | | | | | | | | | | | | | | 165 |
| | | | | | | | | | | | | | | 180 |

Fig. 2

300

********FINANCIAL STATEMENT for _____ ********

Age _____

Salary (in 100's) _____

Credit Limit _____

---

IOU's _____ +

Houses _____ +

Stocks _____ +

Bonds _____ +

Cash _____ +

Total Assets _____ =

Total Debt _____ -

Net Worth _____ =

********in thousands********

Fig. 3

100

Fig. 4A

500

Fig. 4B 1,000

Fig. 4C 5,000

Fig. 4D 10,000

Fig. 4E 20,000

Fig. 4F 50,000

Fig. 4G

BOARD GAME APPARATUS FOR THE TEACHING OF FINANCIAL MANAGEMENT PRINCIPLES

DESCRIPTION

Technical Field

This invention relates to the field of financial management and more specifically to an improved method and apparatus for simulating typical financial risks and rewards encountered during a person's lifetime.

BACKGROUND OF THE INVENTION

Financial management is the investment and allocation of limited financial resources for the purpose of maximizing an individual's net worth. Generally, potential return on an investment is related to some extent on the risk of the investment, although unforeseen factors such as acts of God, or the failure of financial institutions may also affect the return on an investment.

While various phenomena may be studied in the abstract, obtaining experience in financial management is extremely difficult since it necessarily requires substantial resources as well as significant amounts of time for resources to be invested and for returns on those investments to be accumulated.

The present invention overcomes this problem by providing a game for simulating financial management wherein players experience the ups and downs of returns on investments over a lifetime. The game of the present invention simulates financial management in a format which is enjoyable and educational to players.

SUMMARY OF THE INVENTION

Accordingly, it is an object of the present invention to provide a method and apparatus for simulating the risks and rewards of managing a financial portfolio in a typical market.

It is also an object of the present invention to provide a method and system within the simulated financial environment that allows players to choose starting and ending parameters representing a range between very low and very high net worth. These choices allow players to participate in activities generally associated with various stages of wealth, and at the same time approximates the length of play.

It is another object of the present invention to provide a method and system for presenting the principles of financial management in a format which is enjoyable and easy to understand.

It is still another object of the present invention to provide a method and system for providing a simulated financial environment wherein a player may select alternate income sources to experiment with various strategies for maximizing personal net worth.

In summary, the present invention contemplates a method and apparatus for simulating the management of a financial portfolio wherein various financial events are represented by fields on a game board. Each player selects a token which is advanced around the game board based on random criteria such as rolling dice wherein each circuit around the board corresponds to a single year. As each player's token is advanced about the board, a player receives a salary and other income based on investments, receives the opportunity to make further investments and is faced with the prospect of financial setbacks, such as reduction in income and/or loss on investments. The process continues for a predetermined period (corresponding to all or a portion of a person's lifetime) wherein the effectiveness of the player as a financial manager is measured by accumulated net worth at the end of the predetermined period.

BRIEF DESCRIPTION OF THE DRAWINGS

The above and other objects may be fully appreciated through the description below and the accompanying drawings in which:

FIG. 2 is a group of tables used to establish starting parameters for the game of the present invention.

FIG. 3 is a diagram of a spreadsheet used to track net worth in accordance with the present invention.

FIGS. 4A–4E are exemplary diagrams of currency used during the game of the present invention.

DETAILED DESCRIPTION OF THE INVENTION

Figure 1A:
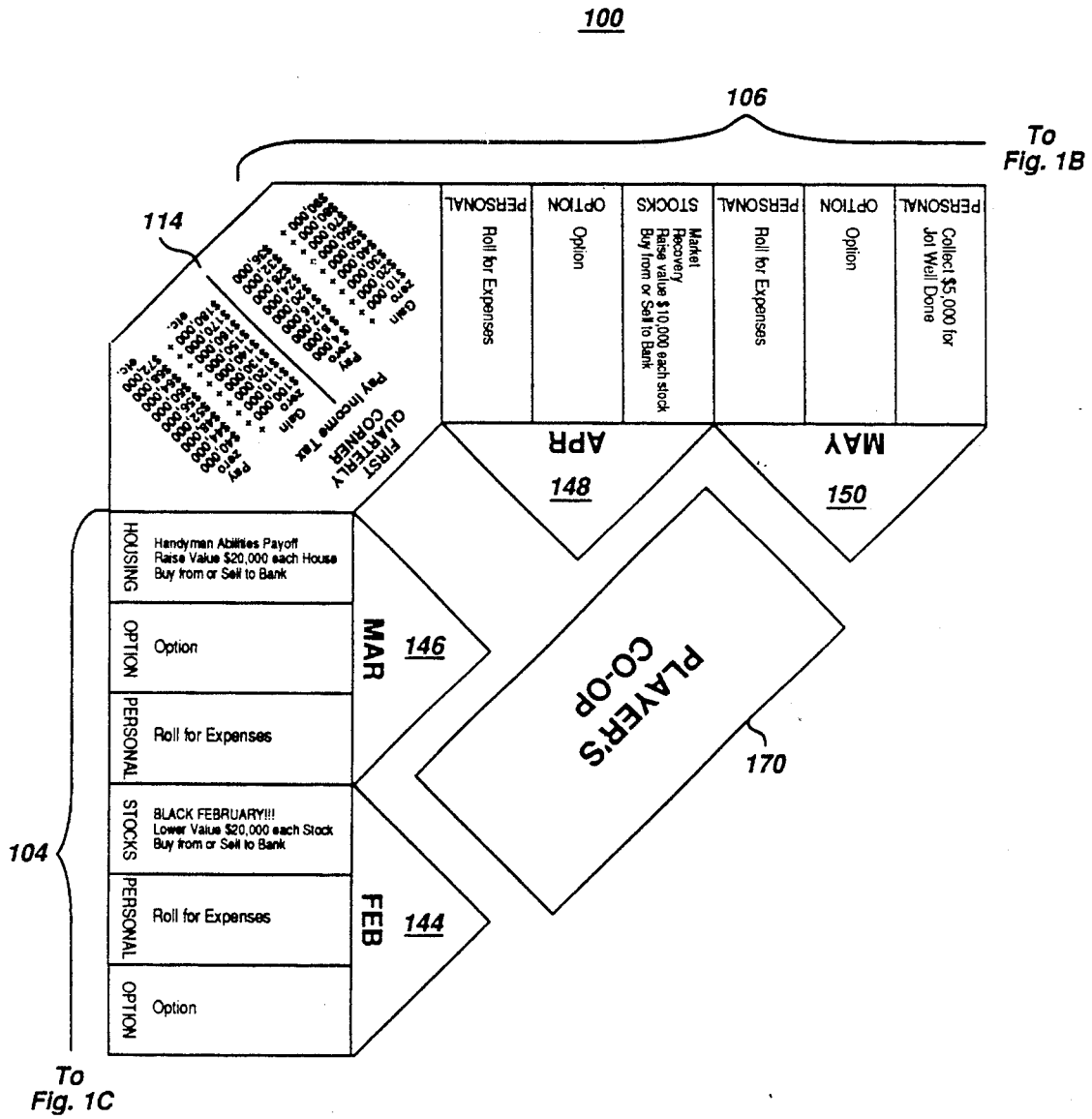
FIG. 1A is a plan view of the top left quadrant of the square game board.
Figure 1B:
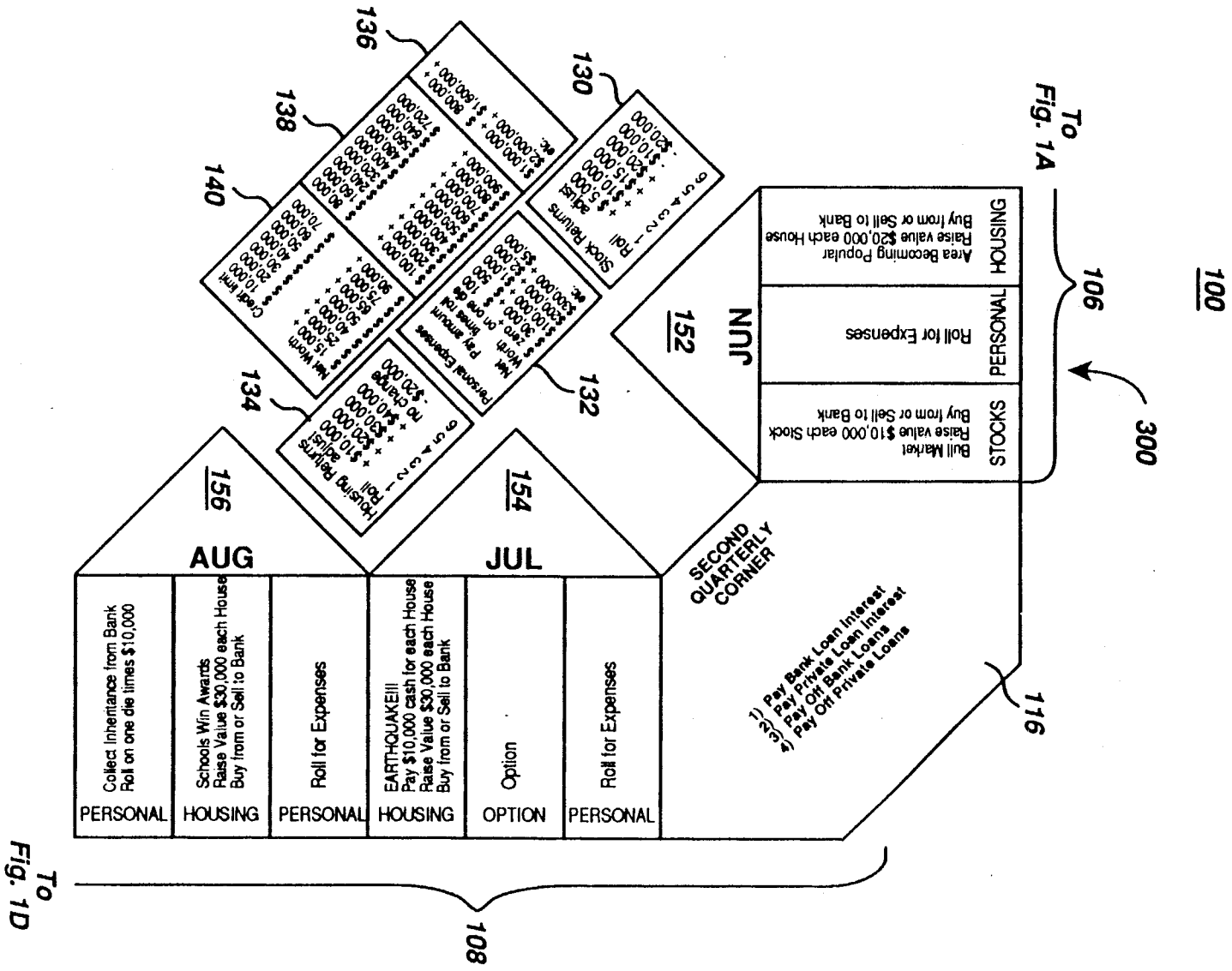
FIG. 1B is a plan view of the top right quadrant of the square game board.
Figure 1C:
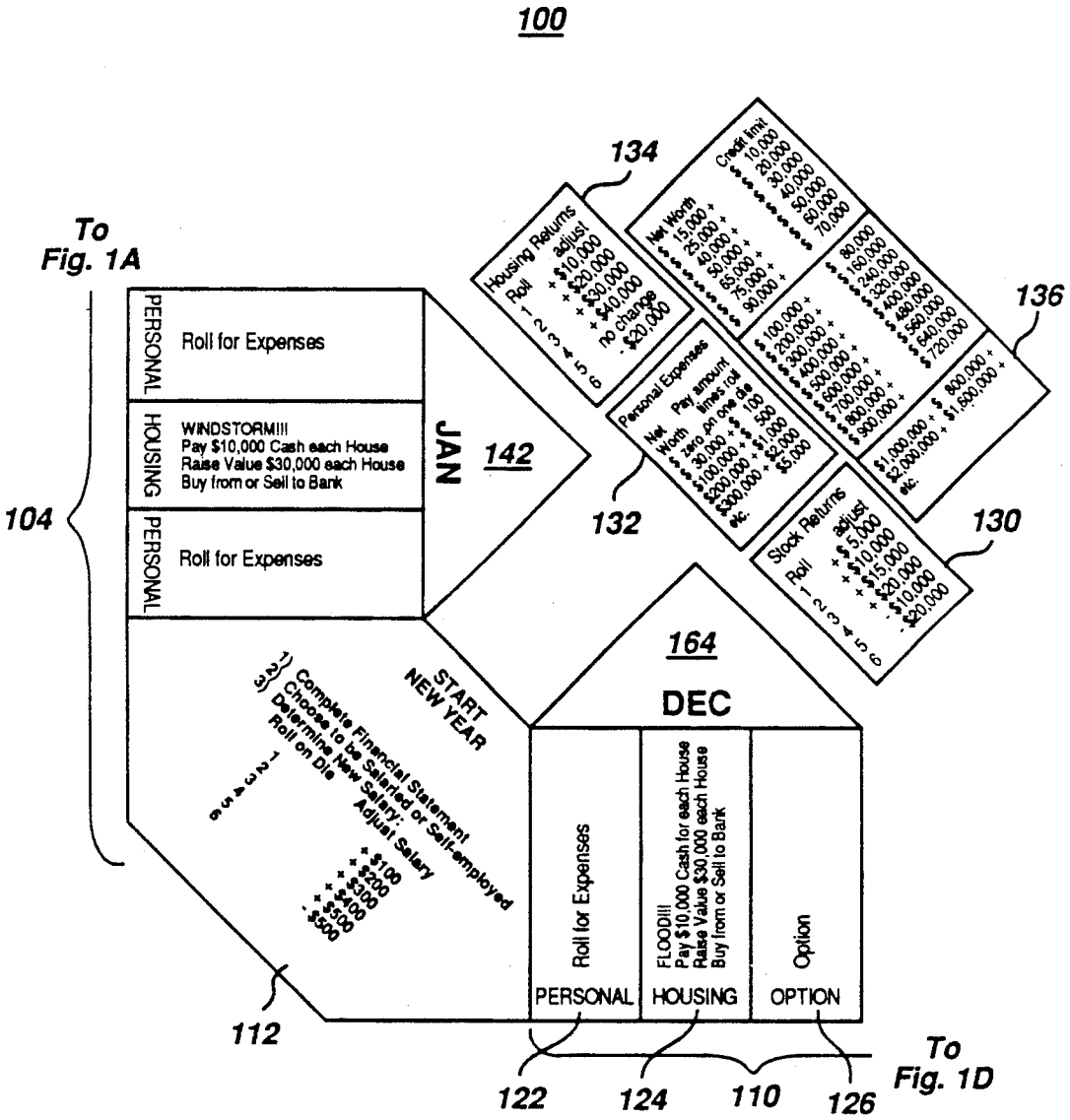
FIG. 1C is a plan view of the bottom left quadrant of the square game board.
Figure 1D:
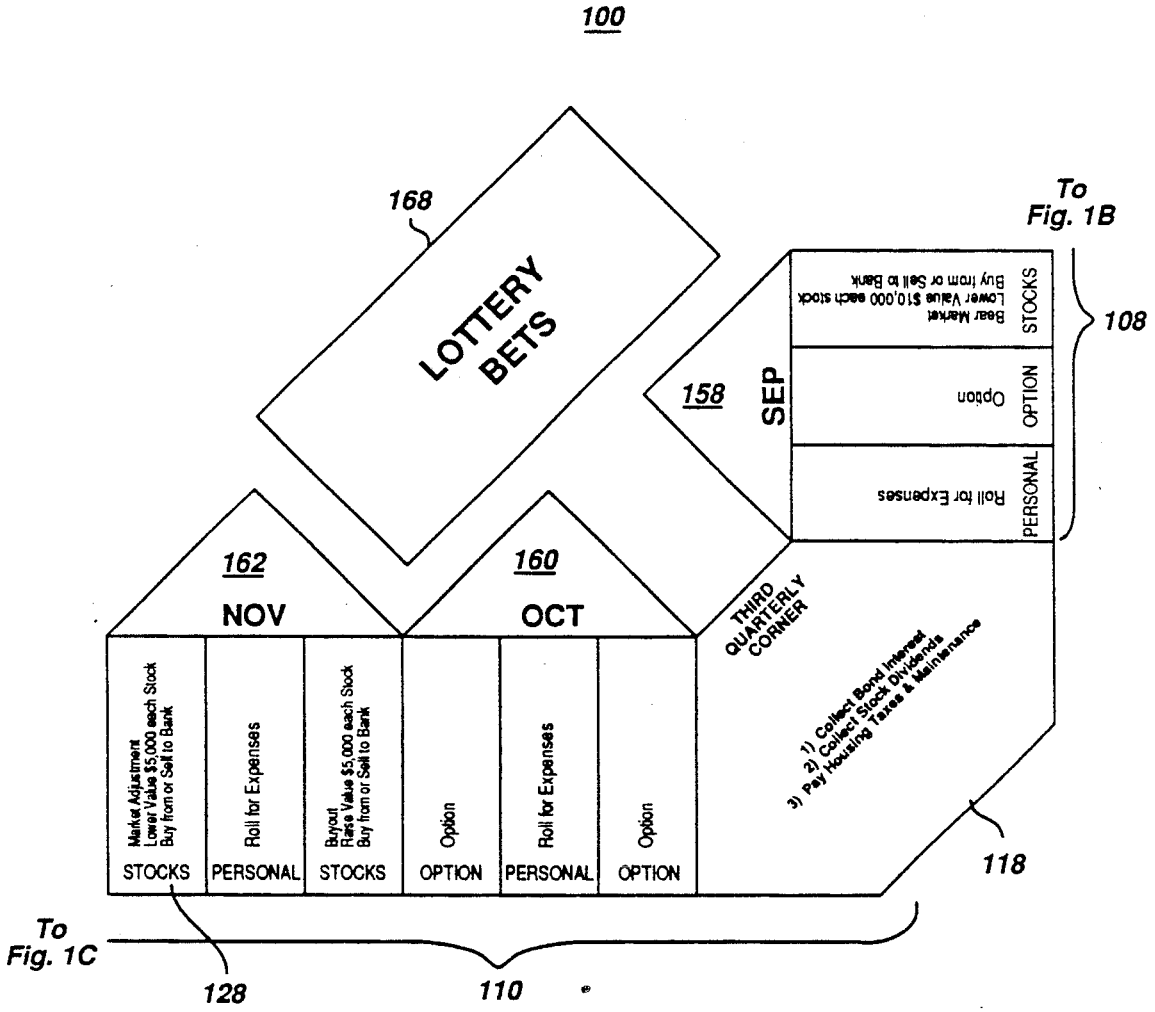
FIG. 1D is a plan view of the bottom right quadrant of the square game board.
Figure 5A:
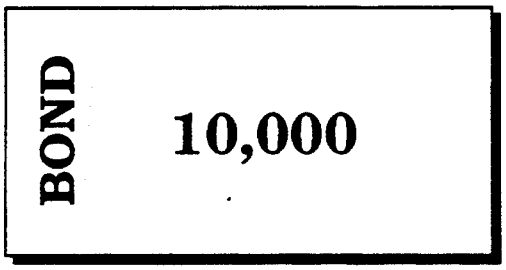
FIGS. 5A–5D are exemplary diagrams of loans and bonds used during the game of the present invention.
Figure 5B:
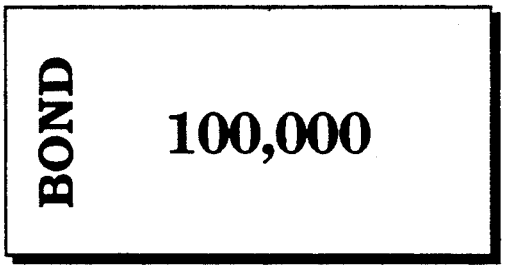
Figure 5C:
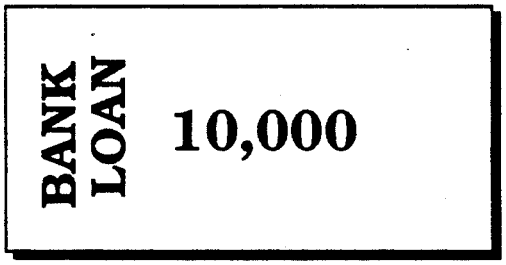
Figure 5D:
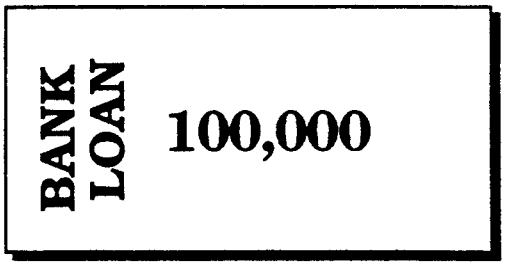

The operation of the present invention is based on a game board 100 which is divided into four areas 104–110, each of which represent a quarter in a typical financial cycle. Quarterly corners 112–118 mark the beginning of each quarter. Quarterly corner 112 indicates the beginning of a new year wherein an annual salary for each player is established. In quarterly corner 114, annual taxes are paid. In quarterly corner 116, annual interest payments are paid. In quarterly corner 118, annual bond interest and dividends are received, and annual housing expenses are paid.

Between each of the respective quarterly corners, four categories of fields representing financial strategy decisions to the player are dispersed randomly around the board 100. The four categories represent decisions which must be made in personal finance, housing, options and stock, as represented by fields 122–128, respectively. These fields are used in conjunction with a plurality of tables 130–140 to calculate various expenses and returns on investments. For example, field 122 is used to calculate and pay dollar amounts for personal expenses. Expenses are calculated and paid to the Players' Co-Op when a player rolls one die and refers to table 132; any player may also play the lottery at this time. In field 124, a player rolls dice and the value of housing investments is adjusted based on the amounts in table 134, subsequently the player may buy from or sell to the bank one house; and in field 128, a player rolls dice and the value of the player's stock is adjusted based on the values in table 130, subsequently the player may buy from or sell to the bank one stock. In field 126, the player is given the option to buy or sell housing or stocks to any other player. The lottery field 168 and the Players' Co-op field 170 are used to enhance the realism and enjoyment of the game wherein players may make bets during certain turns. Proceeds from bets are placed in the Players' Co-op and a portion of the funds in the Players' Co-op is received (based on the amount bet) if the player wins the lottery.

The mainstream of travel is about the outer ring of fields. If at any time, a player becomes insolvent, the player moves to the inner ring of triangular fields 142–164, which represent the 12 months of the year. The player remains in the inner ring until such time as all debts are paid and the player again becomes solvent.

The game of the present invention is initiated by first selecting starting and ending parameters. The game is arranged so that a player begins at 15 years of age, with no job and no money. Assuming a player makes only conservative investments, a player should accumulate a net worth of approximately $1,000,000 by the end of the game. The length of the game may be selected by varying the starting age and the ending net worth by using the tables shown in FIG. 2. For example, in table 202, a starting age and salary are selected. An ending net worth may be selected in table 204 and the resulting length of the game is indicated in table 206, as indexed by tables 202 and 204. Tables 202–206 may be used in any combination to select a desired length of play or a desired net worth, etc. For intermediate or multimillion-dollar amounts not listed in the tables above, starting and ending parameters may be calculated according to the relationships set forth below:

Starting Parameters known net worth:
salary = (square root of net worth) × 8.333
age = (salary + 2,500) × 0.006
known salary:
age = (salary + 2,500) × 0.006
net worth = salary × salary × 0.0014
known age:
salary = (age − 15)/0.006
net worth = (age − 15) × (age − 15) × 400

Ending Parameters assume
a = length of game in minutes
b = number of players
c = starting age
d = starting salary Ending net worth may be determined according to either of the formulae below:

$$(((a \times 833)/b \times 15)) + d)^2 \times 0.0144 \quad 1.$$

$$(((a/(3 \times b)) + c - 15)^2) \times 400 \quad 2.$$

In addition to the above parameters, players may select a form of employment. Specifically, a player may choose to be salaried or self-employed. Self-employed players are presented with several advantages and disadvantages. For example, self-employed players can act any time they foresee a gain or loss. Any number of houses or stocks may be bought or sold to any player at any time. If upon passing the first quarter, the player has a net loss, they receive a tax rebate. In the option fields, the self-employed player may buy or sell any number of houses and stocks from or to the bank. If a self-employed player becomes insolvent, a $500 welfare payment is collected from the bank in lieu of salary. The disadvantages of choosing the self-employment option are that the self-employed player receives no monthly salary, and salary is reduced if the player again becomes a salaried player.

During the game, players receive a salary, pay expenses and make investments, etc., all of which contribute to the player's net worth. In accordance with this invention, a financial statement 300, as shown in FIG. 3, is used to maintain an ongoing record of the player's current net worth. By calculating net worth on an annual basis, players fully appreciate the effect of various investments on net worth, thereby providing constant feedback as to the effectiveness of a chosen financial strategy.

The detailed operation of the game of the present invention is as follows. After selecting beginning parameters, each player selects a token and the order of play. Each player advances around the board in a clockwise direction, each player proceeding in turn. All players begin the game at the "Start New Year" field 112. The total of the roll of two dice determines the number of spaces to move forward. In the event the dice produce "doubles", the player rolls for return. This aspect of the present invention is discussed in more detail below. After moving forward, the order of business is chronological:

1) Collect salary and pay or collect rents for each month entered. Salary, rents, etc., are received and paid in currency which may be of the type shown in FIGS. 4A–4F.

2) Follow the directions of any Quarterly Corner passed in sequential order.

3) Follow the directions of the field landed on.

To satisfy all the above requirements a player may use either cash or borrowed money. If all obligations cannot be met, a player becomes insolvent or destitute. If a player lands within a month of where another player lies destitute, he must make a donation of 10% of his net worth as last recorded on his financial statement, to the destitute player.

At the beginning of each year, upon passing field 112, each player completes their respective financial statements. All amounts entered on the financial statement are preferably recorded as the lowest even five thousand. At the beginning of each year, the player determines a new credit limit for the year by comparing net worth with the credit limit charts 136–140. For example, if a player has a net worth of $720,000, the player's credit limit would be $560,000 + $10,000 = $570,000. In one aspect of the present invention, players may agree on a predetermined retirement age. If a player reaches this predetermined age, that player retires and waits for younger players to record an equal age. After all players have recorded an equal age, the player with the highest net worth is deemed the most successful financial manager.

If a player wishes to become self-employed, no salary is calculated at the beginning of the new year. If a player changes from salary to self-employment, their new salary is set at 50% of the salary of the previous year, or at a $500 per month minimum. Salaried players calculate a new salary at the beginning of every year. A new salary is calculated by rolling one die and adjusting the previous year's salary by the amount indicated in field 112. The minimum salary is zero. For the first initial year of play, any asset may be purchased from the bank.

Other details of the game of the present invention are set forth below. In the first quarter, income tax is due and payable to the bank. Taxes are calculated according to the values set forth in field 114. Taxes are due upon first entering the first quarter regardless of which field is initially encountered. No tax is due in the first year.

Tax is paid on the gain in net worth from the previous year.

Loan payments are due upon passing the second quarter. Loans may be represented by bank notes of the type shown in FIGS. 4C–4D. No interest or penalties are due until the following year on any new loans received in the second quarter. The payment of penalties allows a player to postpone paying off a loan that is due until the following year. The following steps are performed in order:

1) Pay $1,000 interest per note on bank loans. If the player cannot pay interest on any bank note, his credit limit for the next three years is zero.

2) Pay $2,000 interest per note on private loans.

3) A player may optionally pay off bank loans. Any bank loans over the predefined credit limit as shown on the financial statement are due first. If a note is due and the player chooses not to pay it off, a $1,000 penalty per note must be paid, and the next year's credit limit is calculated at a rate of 50% of the current year's credit limit. If a penalty on a currently due bank loan cannot be paid, the credit limit is reduced to zero for the next three years.

4) A player may optionally pay off private loans. If a note is due and a player chooses not to pay it off, a $2,000 penalty must be paid and the due date of all remaining loans due to that lender accelerates to the second quarter of the following year.

When a player passes the third quarter, various returns on investments and expenses are paid. For example, in the third quarter each player:

1) collects $1,000 for each bond owned, 2) collects $5,000 for each stock owned, and 3) pays $5,000 for taxes and maintenance to the bank, for each house owned.

At the beginning of each month, salary is collected and rent is due. The amount of rent due is based on the number of houses owned and is paid to or collected from the bank at the appropriate time during the player's turn as follows:

| No. houses owned | Each month |
|---|---|
| 1 | pay $500 |
| 2 | -0- |
| 3 | collect $1,000 |
| 4 | collect $2,000 |
| etc. | etc. |

If a player depletes all his assets and still has outstanding debt, the player is insolvent or destitute. In this state, the player moves to the inner path formed by fields 142–164. If the player is currently on a quarterly corner, the player moves his token to the following month without collecting salary. When a player becomes insolvent, he compiles a list of creditors and on subsequent turns he performs the following steps in order:

1) Pay as many of the oldest amounts on the list of creditors as possible. If all creditors are paid off, the player rolls the dice and begins counting on the first month where the player is no longer insolvent.

2) Move forward to the next month, collecting salary. No rent is due. If the player passes any quarterly corner, the player collects the amount due and adds amounts owed to the list of creditors.

3) The player may play the lottery if desired.

When a player plays the lottery, the bet must be made as the last transaction before passing the dice to the next player. A $100 bet nets 10% of the total funds in the Players' Co-op. A $500 bet nets 50% of the funds. Percentages are based on the lowest even $10,000 currently in the Players' Co-op.

The bet is made by placing one die showing a number one through six on the appropriate number of dollars on the betting area in the center of the board. Roll the other die. If the player's number comes up, the player collects a percentage of the Players' Co-op and takes back the original bet. If the player loses, the player forfeits the bet to the Players' Co-op. Only one bet on one number is allowed per turn.

If, as noted above, the player must "roll for return," one die is rolled to determine a gain or loss on first, all of the player's houses as determined according to table 134, then a second roll for all of the player's stocks as determined according to table 130. The gain or loss is added or subtracted from each deed, thus giving the deed a new net value. The new net value may never go below zero.

After the player completes his "roll for return," or if the player owns no houses or stocks, the dice are rolled again and the player moves forward the amount indicated. If the roll is doubles again, the player repeats the "roll for return." Forward moves are not permitted on doubles.

Assets are bought and sold according to the following rules:

Bonds: These may be bought or sold at any time during a player's turn. Transactions may be with the bank or between players. Each time the bank buys or sells a bond the player must pay a 10% ($1,000) bank fee per bond.

Houses and Stocks: Houses purchased from the bank cost $100,000 plus a 10% ($10,000) bank fee. Houses sold to the bank are for present asset value less a 10% bank fee. Asset value at purchase is $100,000. Individual deeds (not shown) for each house should show the asset value (which will be adjusted up and down during the course of the game). Purchases are with cash or credit.

Stocks are handled in much the same manner as houses with individual deeds (not shown) costing $50,000 plus a 10% ($5,000) bank fee. Sales to the bank are also for asset value less a 10% bank fee. Asset value at purchase is $50,000.

IOUs: Any player at any time may sell any IOUs to any other player.

All Assets: Transactions between players are not subject to the 10% bank fee. At the time of the transaction, the asset value does not change, regardless of what the purchaser pays the buyer for a bond, house, stock or IOU. Any player at any time may sell any number of houses and stocks to the bank for 50% of their asset value (no bank fee).

Money can be borrowed at any time. All interest and penalties (if applicable) on all loans is due once every year when passing second quarter field 116 and is payable in cash to either the bank or individual player as the case may be. Loans may be paid off only at second quarter field 116.

Bank Loans: Are available in $10,000 increments only. Players may borrow from the bank up to the amount of their current credit limit as shown on their financial statement. A loan fee of 10% ($1,000) must be paid for each $10,000 bank note at the time of the loan. There is no due date on bank loans as long as a player remains within his credit limit.

Private Loans: Between players are also available in $10,000 increments only. The interest rate is 20% and there is no loan fee. Private loans are not subject to any credit limit. Private loans are recorded on a private debt note (not shown) for the borrower and an IOU (not shown) for the lender. All private loans are assigned a certain second quarter due date mutually agreed upon at the time of the loan. Each note preferably shows the borrower, due date and amount of note.

In summary, an improved method and apparatus for simulating financial management has been described. Accordingly, other uses and modifications of the present invention will be apparent to persons of ordinary skill without departing from the spirit and scope of the present invention. All of such uses and modifications are intended to fall within the scope of the appended claims.

I claim:

1. An improved apparatus for simulating financial management with a plurality of players, said apparatus comprising:

a game board including a plurality of fields arranged sequentially about the periphery of said game board wherein said fields are divided into four financial quarters representing a year, wherein said fields include a plurality of investment fields representing opportunities to buy or sell various investments, and representing opportunities to determine the returns on said investments;

a plurality of returns tables corresponding to said investment fields, said return tables each comprising a plurality of indexed monetary amounts;

a plurality of game pieces representing said investments, each game piece having an initial monetary value;

a token for each player to record his movement around the game board;

simulated currency for the exchange of funds while using said apparatus;

dice to generate random criteria for advancing said token about the game board and for generating said indexes in said tables for randomly selecting a monetary amount in said returns tables, said selected monetary amount to be added to the value of said investments to increase or decrease the value of said investments;

bond facsimiles to represent bonds owned by players;

bank note facilities to represent loans owed by players; and a financial statement for each player, said financial statement for tracking the annual net worth of players.

2. The apparatus of claim 1, further including means for calculating the credit limit of each player.

3. The apparatus of claim 1 further including lottery simulation means.

4. The apparatus of claim 1 further including means for simulating the gain or reduction in the value of assets.

5. The apparatus of claim 1 further including means for simulating the gain or reduction of annual salary.

6. The apparatus of claim 1 further including means for simulating the difference between salaried or self employment.

7. The apparatus of claim 1 wherein said board includes a plurality of monthly fields dispersed sequentially about the interior of said board, wherein said monthly fields represent the 12 months of the year wherein insolvent players remain in said monthly fields until they are no longer insolvent, and further wherein players may not make investments while in a monthly field.

8. The apparatus of claim 1, further including the formulae for determining starting and ending parameters, which also calculates an appropriate increased net worth and increased salary in relationship to advancing age.

* * * * *